US011502442B2

(12) United States Patent
Plazio et al.

(10) Patent No.: US 11,502,442 B2
(45) Date of Patent: Nov. 15, 2022

(54) PIN HEADER CONNECTOR

(71) Applicant: MARELLI EUROPE S.p.A., Corbetta (IT)

(72) Inventors: Adriano Plazio, Vinovo (IT); Razvan-Vasile Deji, Cluj (RO)

(73) Assignee: MARELLI EUROPE S.p.A., Corbetta (IT)

( * ) Notice: Subject to any disclaimer, the term of this patent is extended or adjusted under 35 U.S.C. 154(b) by 30 days.

(21) Appl. No.: 17/183,850

(22) Filed: Feb. 24, 2021

(65) Prior Publication Data

US 2021/0265762 A1 Aug. 26, 2021

(30) Foreign Application Priority Data

Feb. 26, 2020 (IT) ..... IT102020000004009

(51) Int. Cl.
*H01R 13/426* (2006.01)
*H01R 43/20* (2006.01)

(52) U.S. Cl.
CPC ..... *H01R 13/426* (2013.01); *H01R 43/20* (2013.01); *H01R 2201/26* (2013.01)

(58) Field of Classification Search
CPC .. H01R 12/724; H01R 13/426; H01R 13/502; H01R 13/506; H01R 13/514; H01R 13/518; H01R 43/20; H01R 2201/26
See application file for complete search history.

(56) References Cited

U.S. PATENT DOCUMENTS 6,171,116 B1 1/2001 Wicks et al.
6,508,676 B1 1/2003 Xu
7,195,519 B1 * 3/2007 McAlonis ..... H01R 13/518 439/701
8,627,564 B2 * 1/2014 Blossfeld ..... H05K 7/1428 361/752
10,348,029 B2 7/2019 Flender et al.
2012/0276761 A1 11/2012 Martin et al.

OTHER PUBLICATIONS

Search Report for Italian Patent Application No. 20200004009 dated Oct. 1, 2020.
Communication dated Jul. 7, 2021 transmitting the Extended European Search Report dated Jun. 29, 2021 for European Patent Application No. 21159753.9.

* cited by examiner

*Primary Examiner* — Oscar C Jimenez
(74) *Attorney, Agent, or Firm* — Howard & Howard Attorneys PLLC

(57) ABSTRACT

A pin header connector having: a peripheral frame having, at the centre, a series of through openings; and a plurality of modules, each of which engages a corresponding through opening and is provided with a series of electrical pin contacts and with a support plate, which is made of a plastic material and has a series of first through holes engaged by the corresponding electrical pin contacts. The peripheral frame has a plurality of linear sliding guides, each of which is arranged in the area of a through opening, is designed to guide an insertion of the support plate of a module into the through opening allowing the support plate to only make a translation in a mounting direction, and is provided with a limit stop ending the insertion. An interlocking connection system is provided, which is activated when the support plate of each module strikes against the limit stop.

18 Claims, 16 Drawing Sheets

PIN HEADER CONNECTOR

CROSS-REFERENCE TO RELATED APPLICATIONS

This patent application claims priority from Italian patent application no. 102020000004009 filed on Feb. 26, 2020, the entire disclosure of which is incorporated herein by reference.

TECHNICAL FIELD

The invention relates to a pin header connector.

The invention finds advantageous application in an electronic control unit for automotive applications, to which explicit reference will be made in the description below without because of this loosing in generality.

PRIOR ART

An electronic control unit for automotive applications comprises a printed circuit board (PCB), which supports an electronic circuit and is provided with a pin header connector.

The pin header connector consists of one or more rows of electrical pin contacts, which are generally spaced apart from one another by a pin distance (commonly referred to as "pitch") ranging from 1.00 millimetres (0.04 inches) to 6.00 millimetres (0.236 inches) with a typical value of 2.54 millimetres (0.1 inches).

In a modern electronic control unit for automotive applications, the pin header connector can comprise a large number of electrical pin contacts (more than two hundred) and, therefore, it can have significant dimensions and relatively high manufacturing costs. When an existing electronic control unit needs to be changed, the corresponding pin header connector needs to be changed as well and the change in the corresponding pin header connector can turn out to be particularly complicated and expensive, especially when the pin header connector has significant dimensions (namely, has a large number of electrical pin contacts).

Patent application US2012276761A1 describes a pin header connector comprising a peripheral frame, which has, at the centre, a series of through openings and one single body, which supports a plurality of modules, each of which engages a corresponding through opening and is provided with a series of electrical pin contacts and with a support plate, which is made of a plastic material and has a series of first through holes engaged by the corresponding electrical pin contacts.

DESCRIPTION OF THE INVENTION

The object of the invention is to provide a pin header connector, which can be manufactured in a simple and economic fashion.

According to the invention, there are provided a pin header connector and a relative mounting method according to the appended claims.

The appended claims describe embodiments of the invention and form an integral part of the description.

BRIEF DESCRIPTION OF THE DRAWINGS

The invention will now be described with reference to the accompanying drawings, which show some non-limiting embodiments thereof, wherein.

PREFERRED EMBODIMENTS OF THE INVENTION

Figure 1:
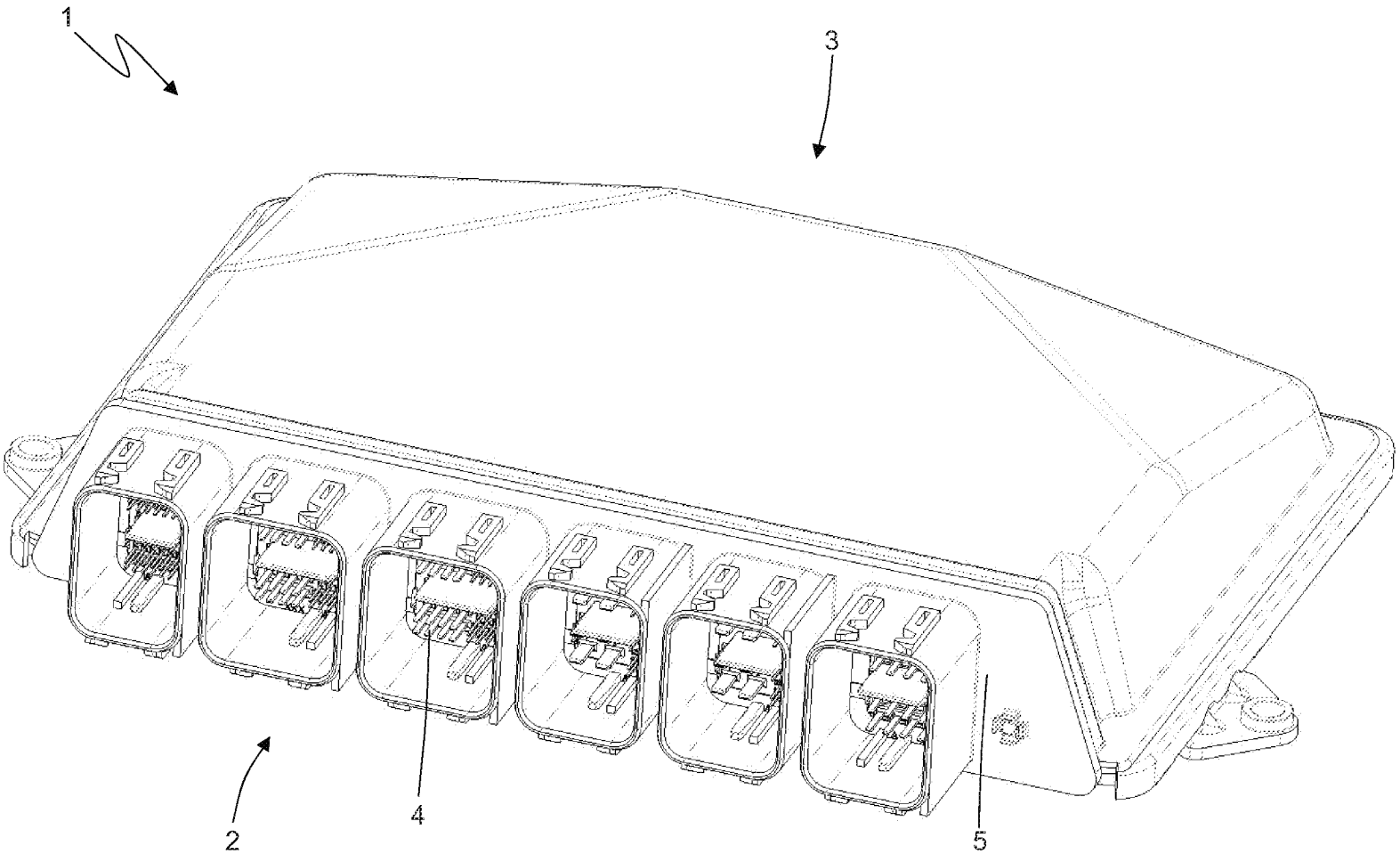
FIG. 1 is a perspective view of an electronic control unit for automotive applications provided with a pin header connector according to the invention.

In FIG. 1, number 1 indicates, as a whole, an electronic control unit for automotive applications.

The electronic control unit 1 comprises a printed circuit board (PCB), which supports an electronic circuit, is provided with a pin header connector 2 and is inserted in a metal or plastic container 3, from which the pin header connector 2 protrudes at an end.

The pin header connector consists of one or more rows of electrical pin contacts 4, which are spaced apart from one another by a distances (commonly referred to as "pitch") ranging from 1.00 millimetres (0.04 inches) to 6.00 millimetres (0.236 inches).

Figure 2:
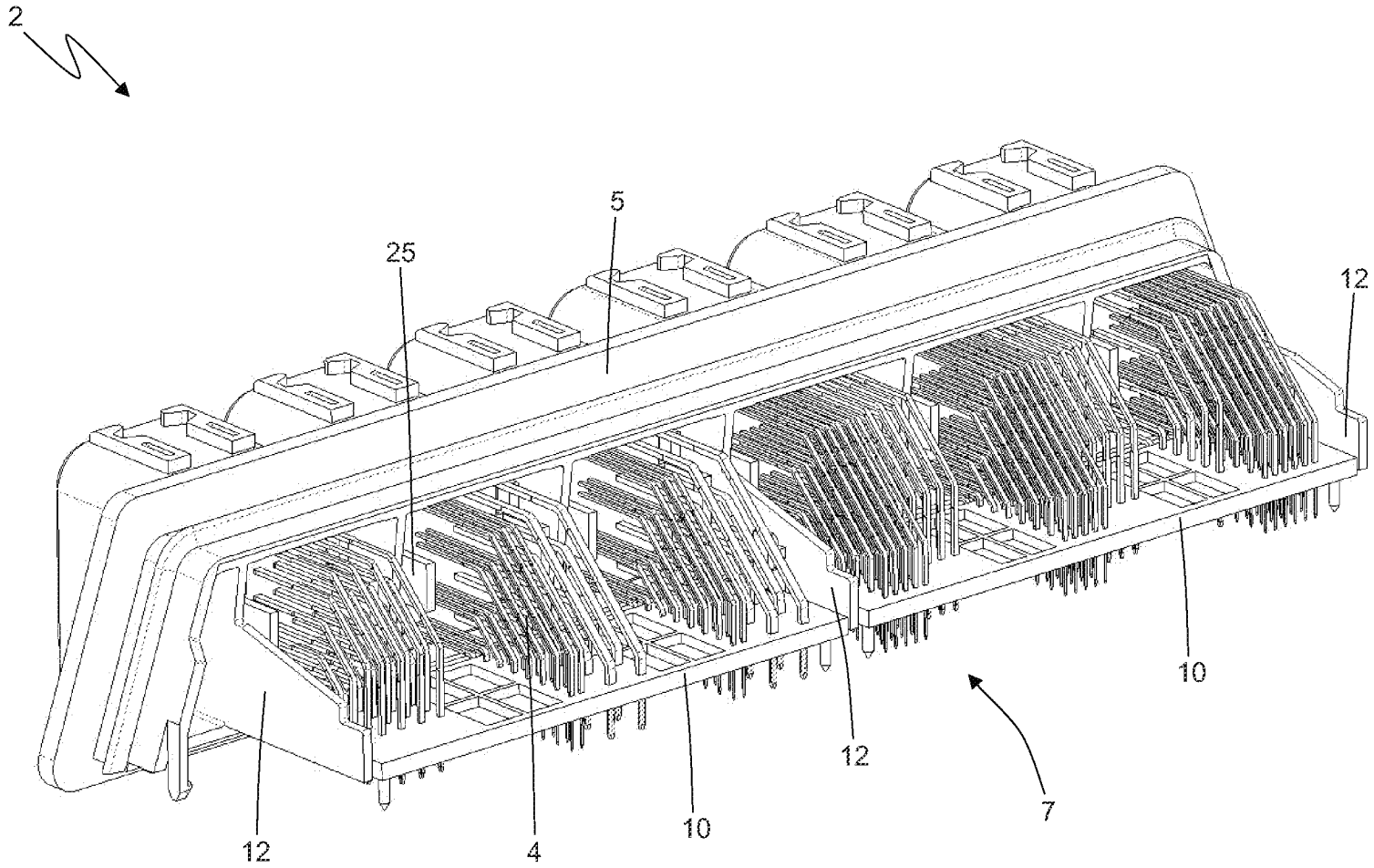
FIG. 2 is a perspective rear view of the pin header connector of FIG. 1.
Figure 3:
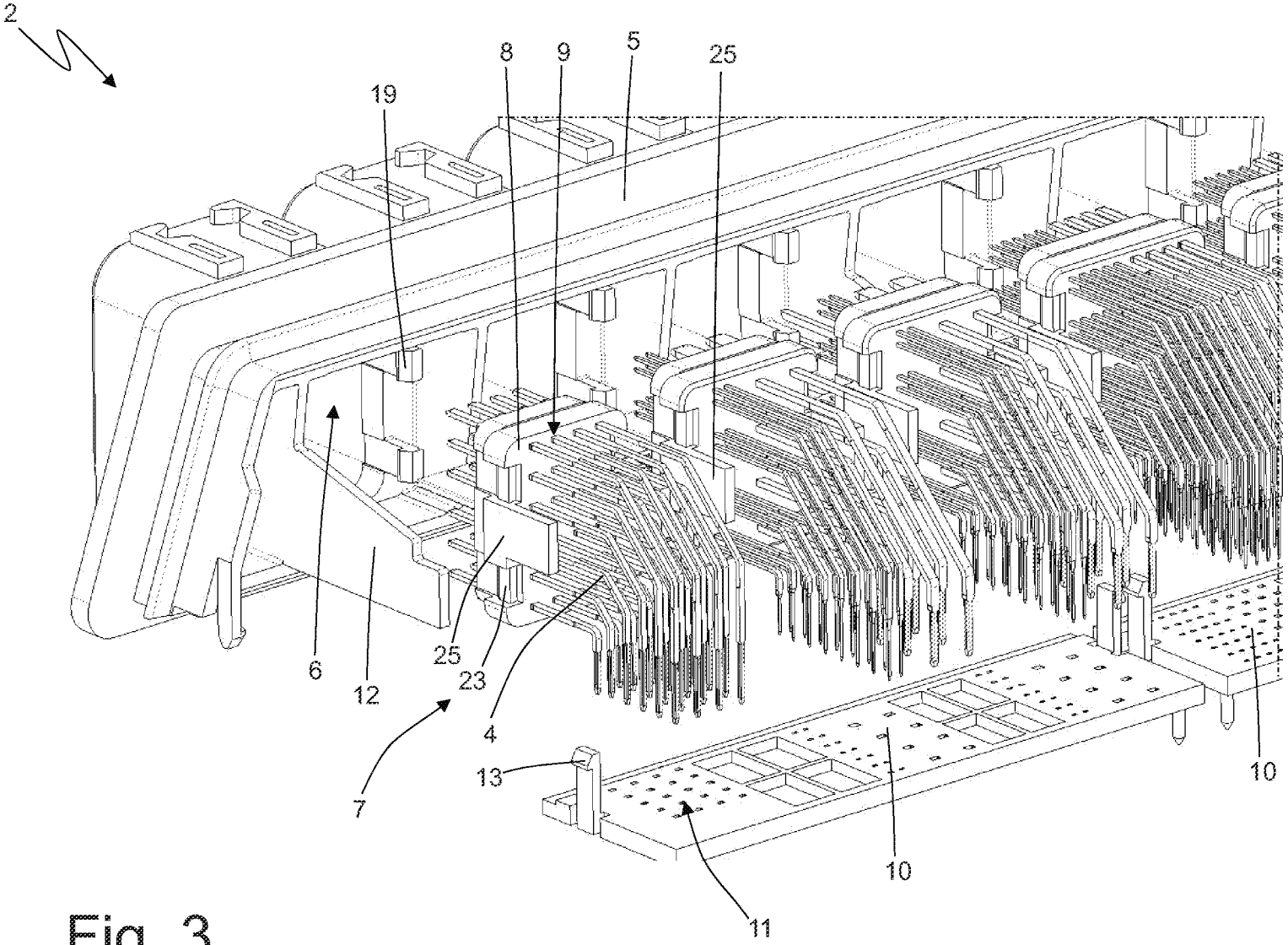
FIG. 3 is a perspective and exploded rear view of a part of the pin header connector of FIG. 2.

According to FIGS. 2 and 3, the pin header connector 2 comprises a peripheral frame 5, which is (preferably) made of a plastic material or (alternatively) of a metal material and has, at the centre, a series of through openings 6 (in particular, six through openings 6 in the embodiment shown in the accompanying figures). Each through opening 6 of the peripheral frame 5 is engaged by a corresponding module 7, which is provided with a series of electrical pin contacts 4 and with a support plate 8, which is made of a plastic material (namely, of an electrically insulating material) and has a series of through holes 9 engaged by the corresponding electrical pin contacts 4. In other words, the support plate 8 of each module 7 is a sort of matrix, in which the electrical pin contacts 4 are firmly housed so as to hold the electrical pin contacts 4 in the desired position.

According to FIGS. 2 and 3, each electrical pin contact 4 has a straight front portion, which engages a through hole 9 of a corresponding support plate 8 and comes out of the pin header connector 2, a rear straight portion, which is perpendicular to the front portion and is configured to be coupled to the printed circuit board, and a joining portion, which connects the front portion to the rear portion.

According to FIGS. 2 and 3, the pin header connector 2 comprises two holding plates 10 side by side, which are arranged perpendicularly to the support plates 8 of the modules 7 and each have a series of through holes 11 engaged by the rear portions of the corresponding electrical pin contacts 4. The function of the holding plates 10 is that of keeping the electrical pin contacts 4 separate from one another, ensuring a firm and secure second anchoring point for the electrical pin contacts 4 before the electrical pin contacts 4 are welded to the printed circuit board (hence, during the production, the storage and the transportation of the pin header connector 2); namely, the electrical pin contacts 4 are anchored to the support plates 8 at the front (since they are arranged through the through holes 9 of the support plates 8) and are anchored to the holding plates 10 at the back (since they are arranged through the through holes 11 of the holding plates 10).

In the embodiment shown in the accompanying figures, each holding plate 10 is associated with three corresponding modules 7, namely the through holes 11 of a same holding plate 10 are engaged by the rear portions of the electrical pin contacts 4 of three modules 7 beside one another. According to other embodiments which are not shown herein, there is a different number of holding plates 10, for example one single holding plate 10 for all six modules 7 or three, four, five or six holding plates 10 besides one another.

The peripheral frame 5 has three mounting brackets 12, which project from the peripheral frame 5 and provide respective anchoring points for the holding plates 10; in particular, each holding plate 10 has two respective hooks 13, which are arranged at opposite ends of the holding plate 10 and are inserted in an interlocking manner (namely, due to an elastic deformation thereof) into respective seats obtained in the mounting brackets 12. The central mounting bracket 12 (arranged at the centre of the peripheral frame 5) is obviously shared by the two holding plates 10, namely it offers support for both holding plates 10.

Figure 5:
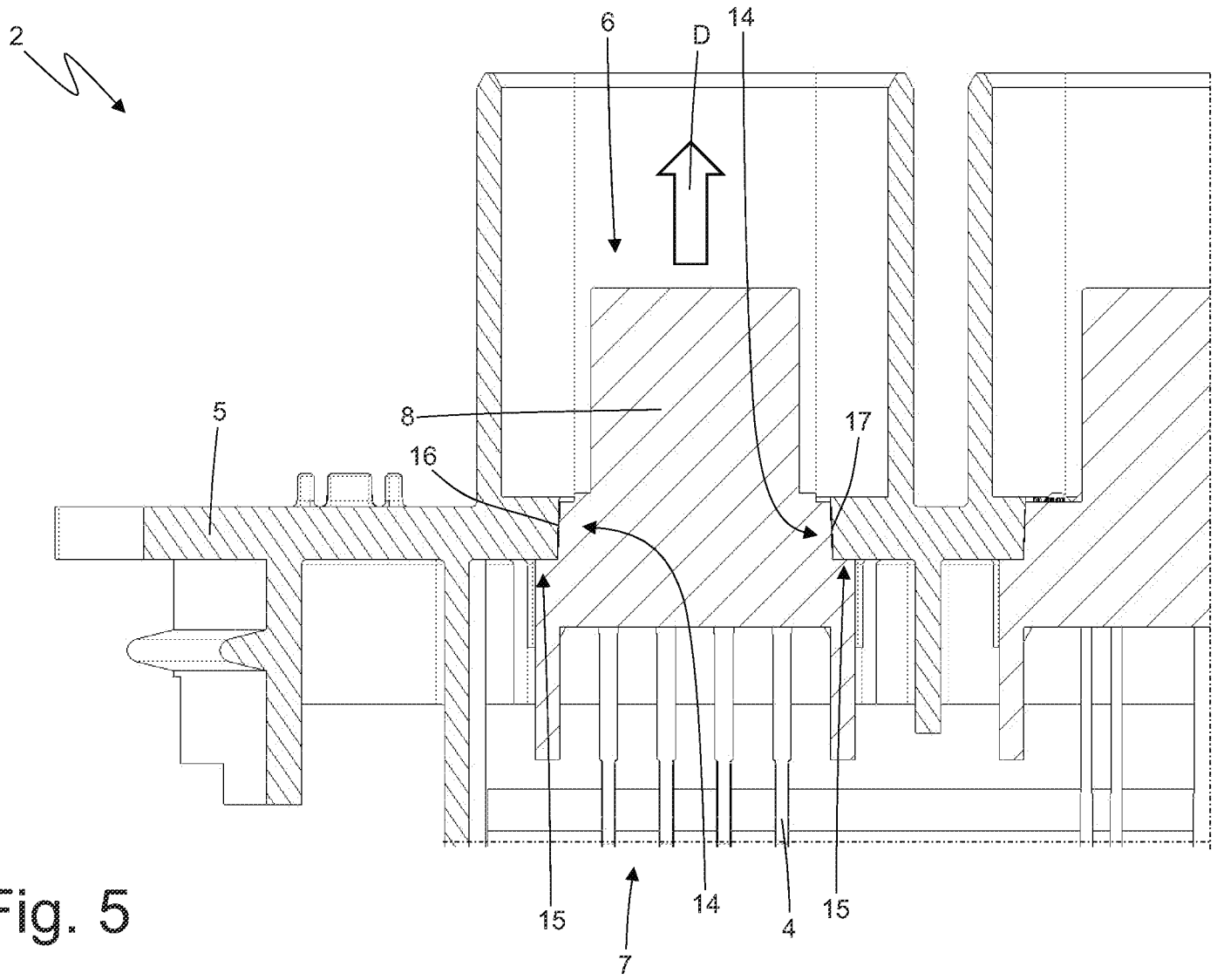
FIG. 5 is a cross-sectional plan view of a part of the pin header connector of FIG. 2.

According to FIG. 5, the peripheral frame 5 has a plurality of linear sliding guides 14, each of which is arranged in the area of a through opening 6, is designed to guide an insertion of the support plate 8 of a module 7 into the through opening 6 allowing the support plate 8 to only make a translation in a mounting direction D, and is provided with a limit stop 15 ending the insertion. In other words, each linear sliding guide 14 consists of a channel, into which a portion of the support plate 8 of a module 7 is inserted with a minimum clearance and, hence, along which the portion of the support plate 8 can only make a translation in the mounting direction D (as it is completely prevented from making any other movement because of the contact with the walls of the channel). Each limit stop 15 consists of a rim of the support plate 8 of a module 7, which is larger than the channel defining the linear sliding guide 14 and strikes against a corresponding rim of the peripheral frame 5 surrounding the through opening 6.

According to a preferred embodiment, each linear sliding guide 14 has a flared shape that progressively reduces its size as the support plate 8 of a corresponding module 7 moves forward in its insertion; in this way, each linear sliding guide 14 carries out a self-centring function. In particular, each linear sliding guide 14 has two inclined guide walls 16 and the support plate 8 of each module 7 has two inclined guide walls 17, which have the same inclination as the guide walls 16 and are coupled to the guide walls 16 (namely, slide on the guide walls 16). By way of example, the guide walls 16 and 17 have an inclination of approximately 2-3°.

Figure 6:
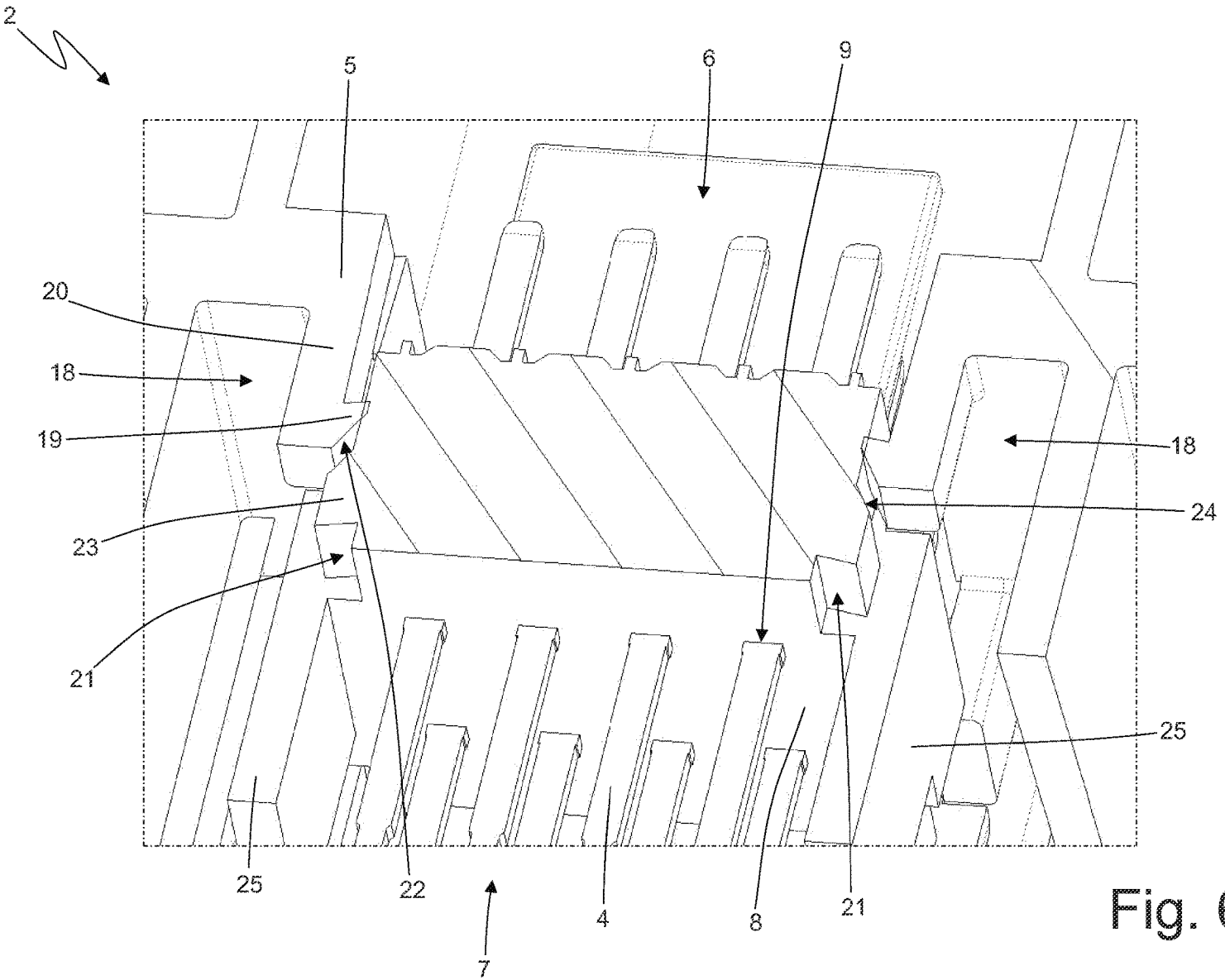
FIGS. 6 and 7 are cross-sectional perspective views of a part of the pin header connector of FIG. 2 during two different mounting steps.
Figure 7:
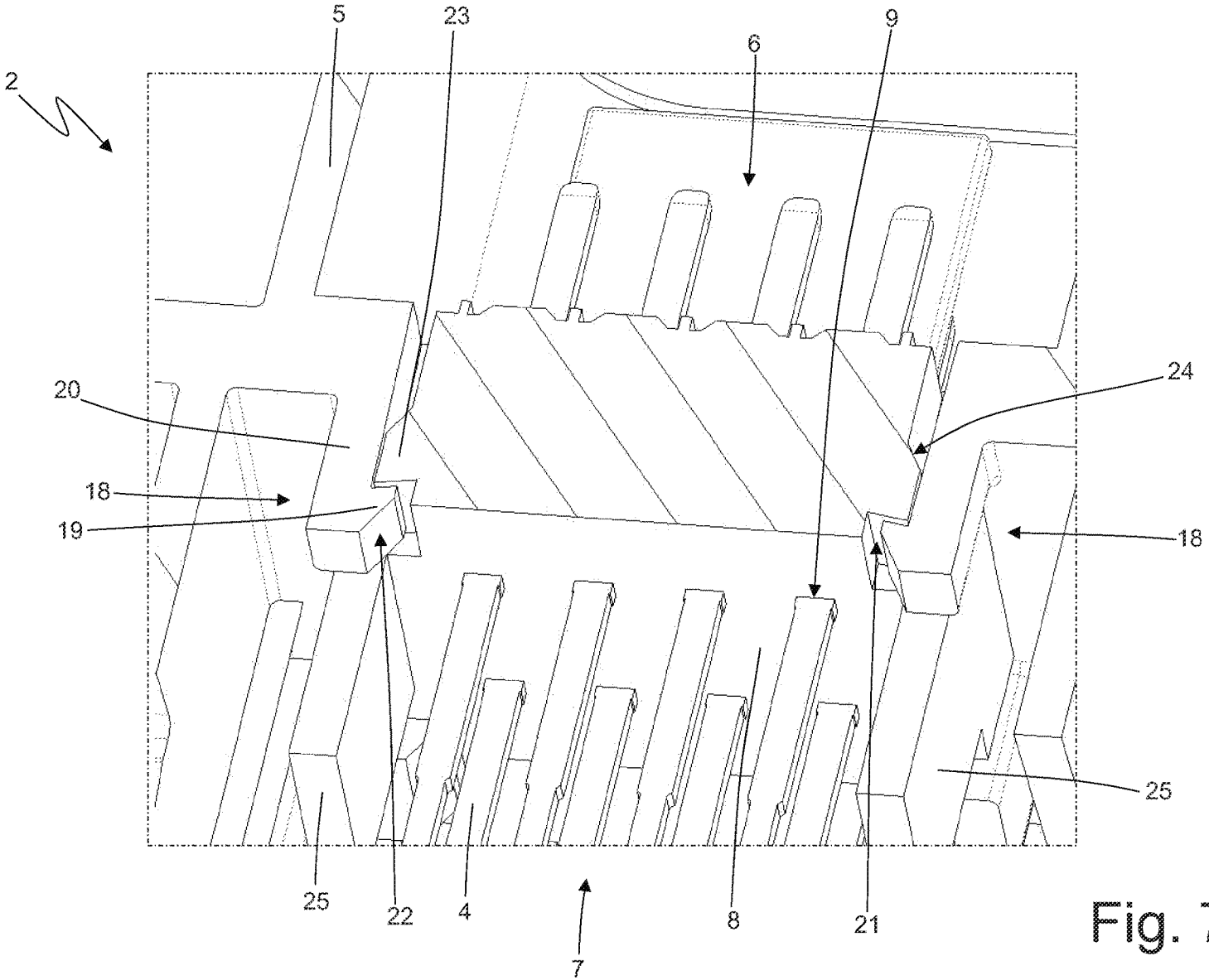
Figure 8:
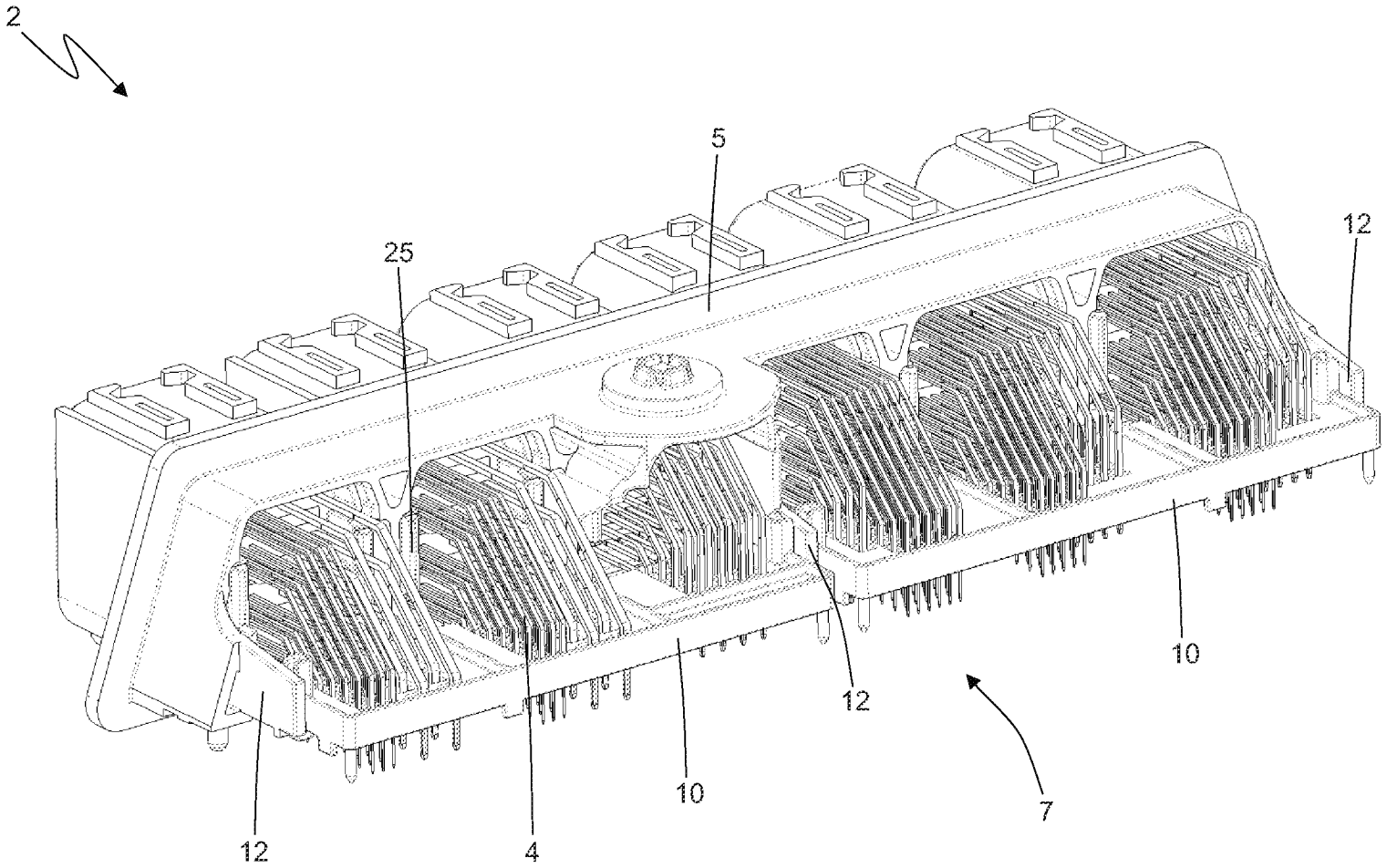
FIG. 8 is a perspective rear view of a different embodiment of the pin header connector of FIG. 1.
Figure 9:
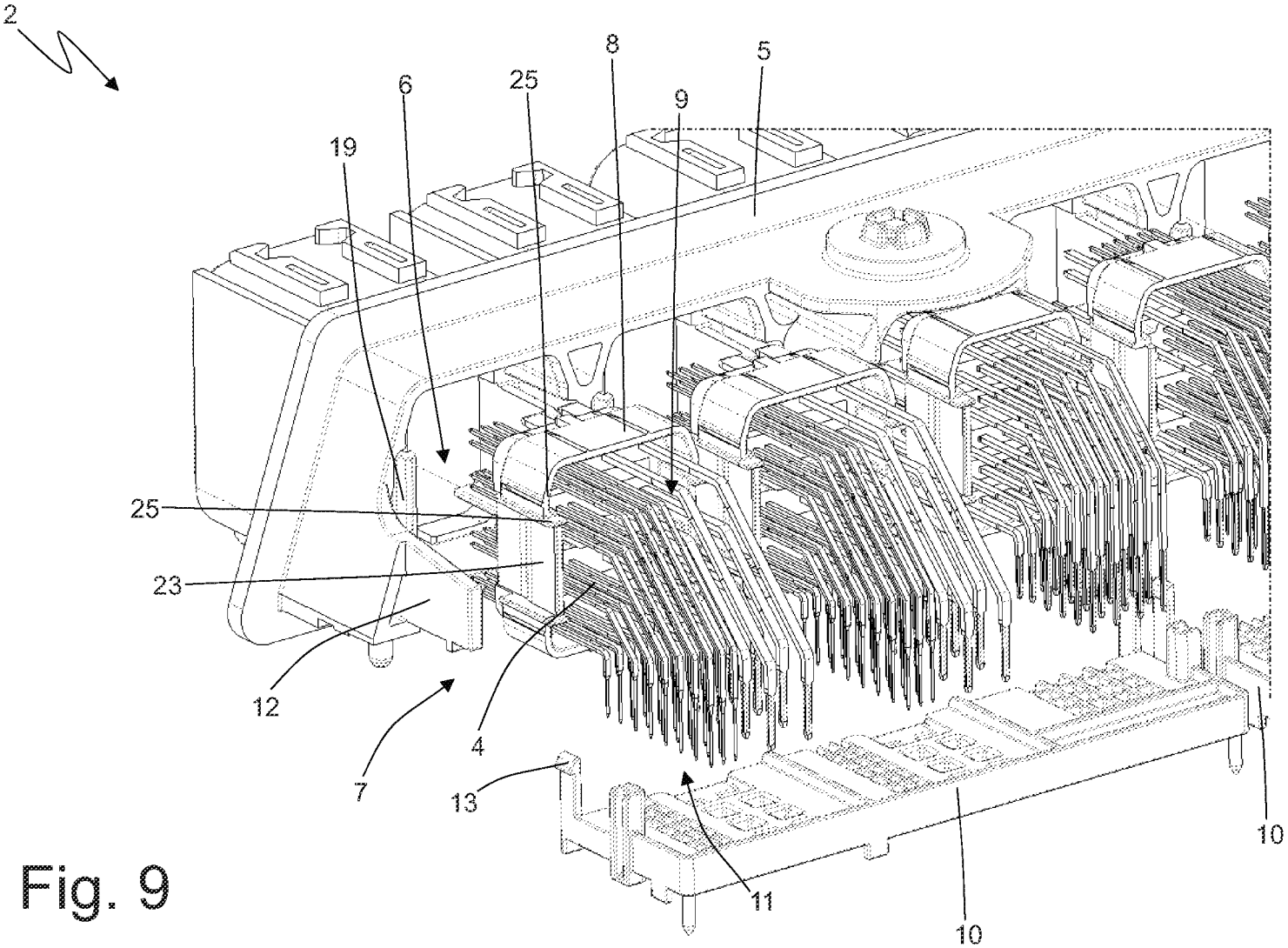
FIG. 9 is a perspective and exploded rear view of a part of the pin header connector of FIG. 8.

According to FIGS. 6 and 7, for each through opening 6, an interlocking connection system 18 is provided, which is activated when the support plate 8 of each module 7 strikes against the limit stop 15 and, once it is activated, prevents the support plate 8 from moving away from the through opening 6, thus creating a firm connection between the support plate 8 and the peripheral frame 5 (namely, a connection that does not allow for any movement between the support plate 8 and the peripheral frame 5).

Figure 4:
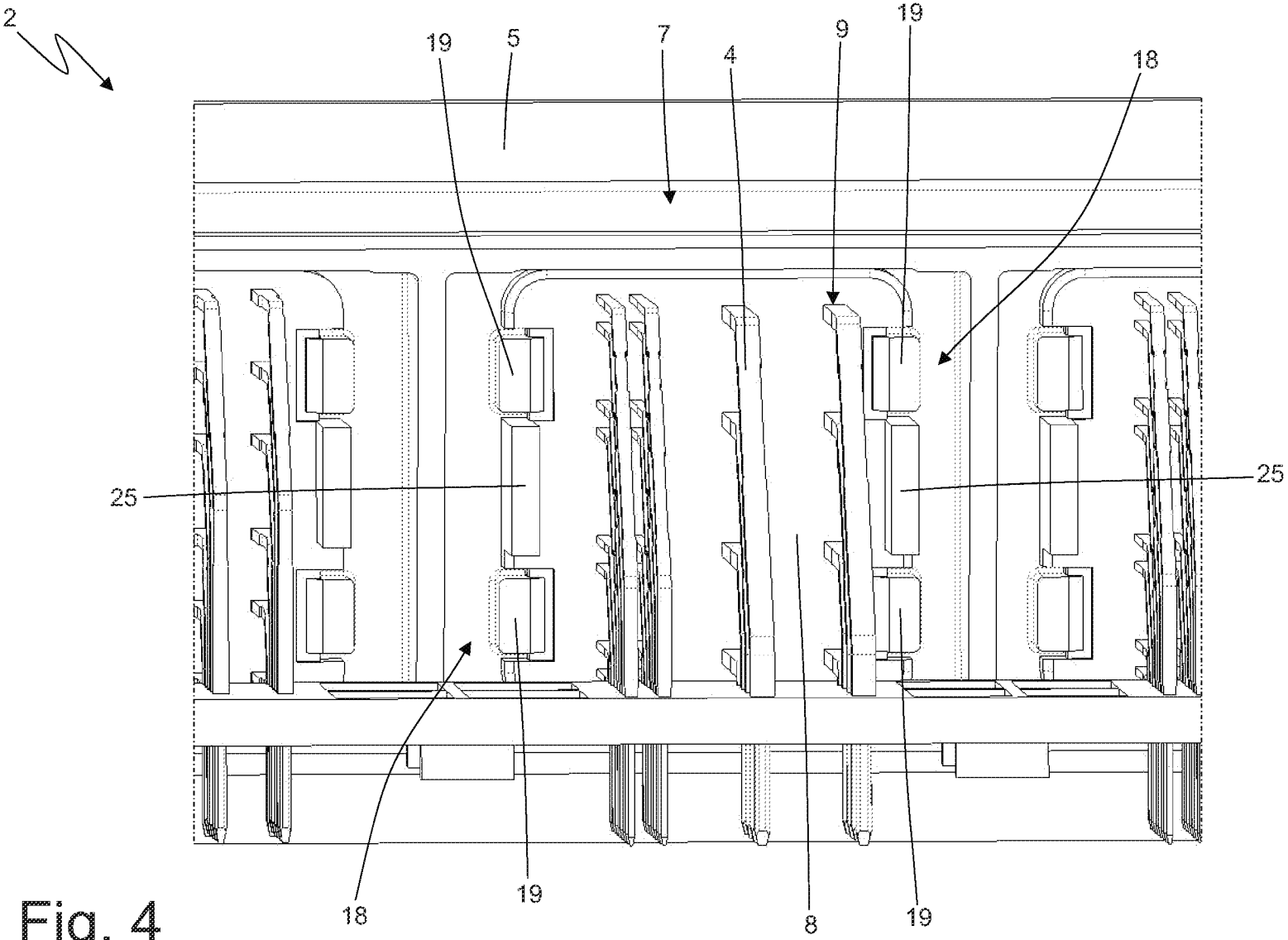
FIG. 4 is a perspective rear view of a detail of the pin header connector of FIG. 2.
Figure 10:
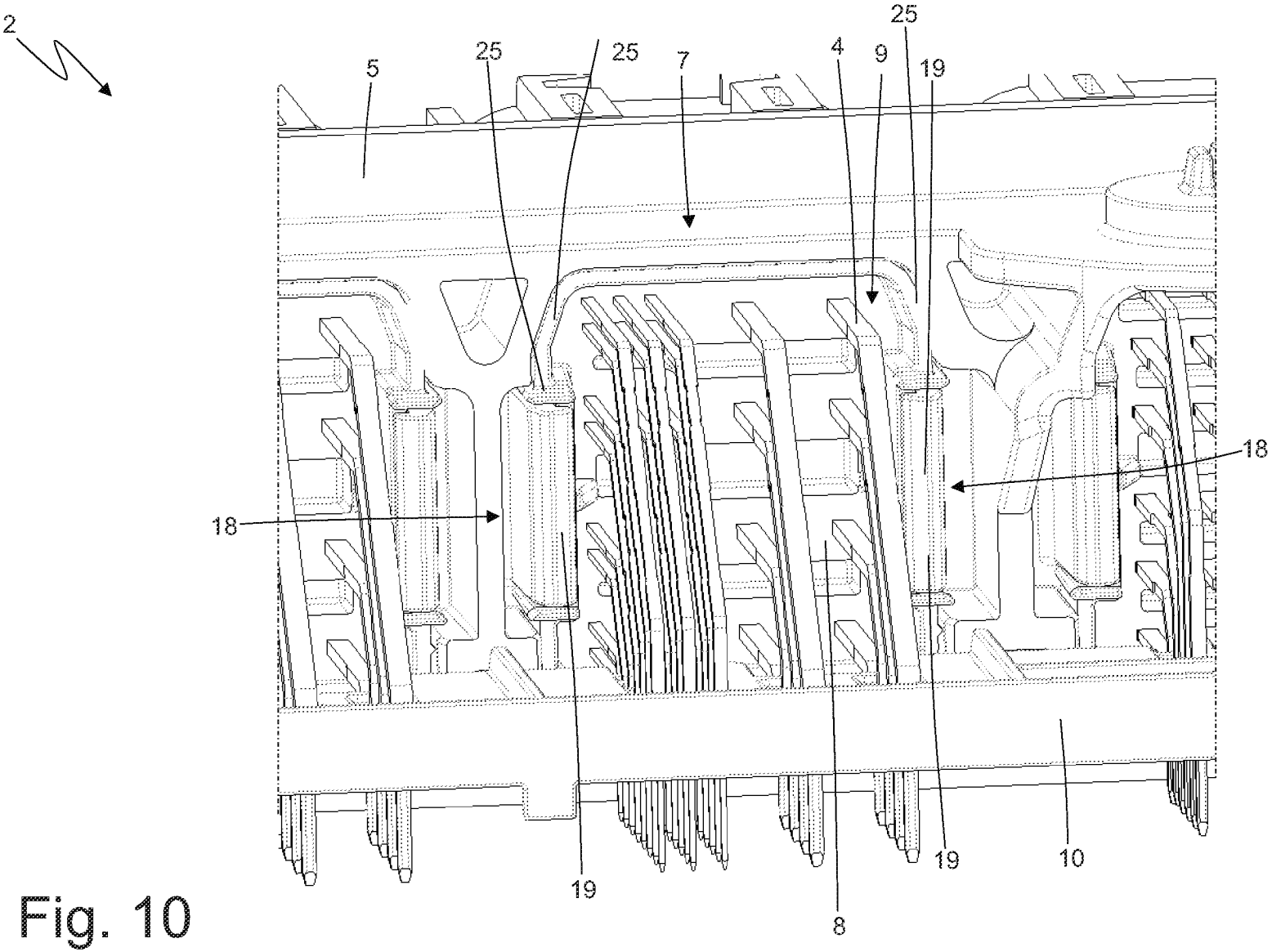
FIG. 10 is a perspective rear view of a detail of the pin header connector of FIG. 8.
Figure 11:
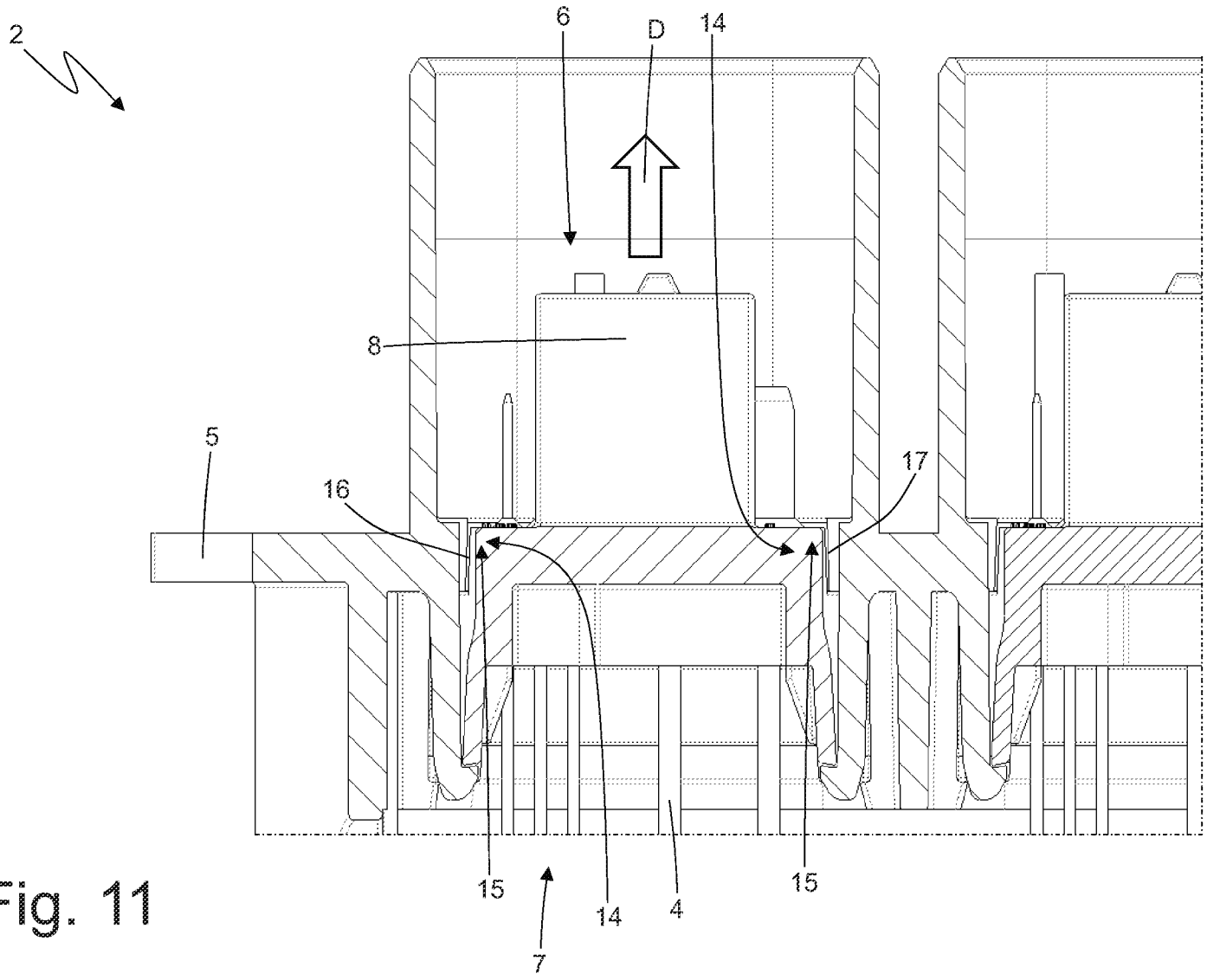
FIG. 11 is a cross-sectional plan view of a part of the pin header connector of FIG. 8.
Figure 12:
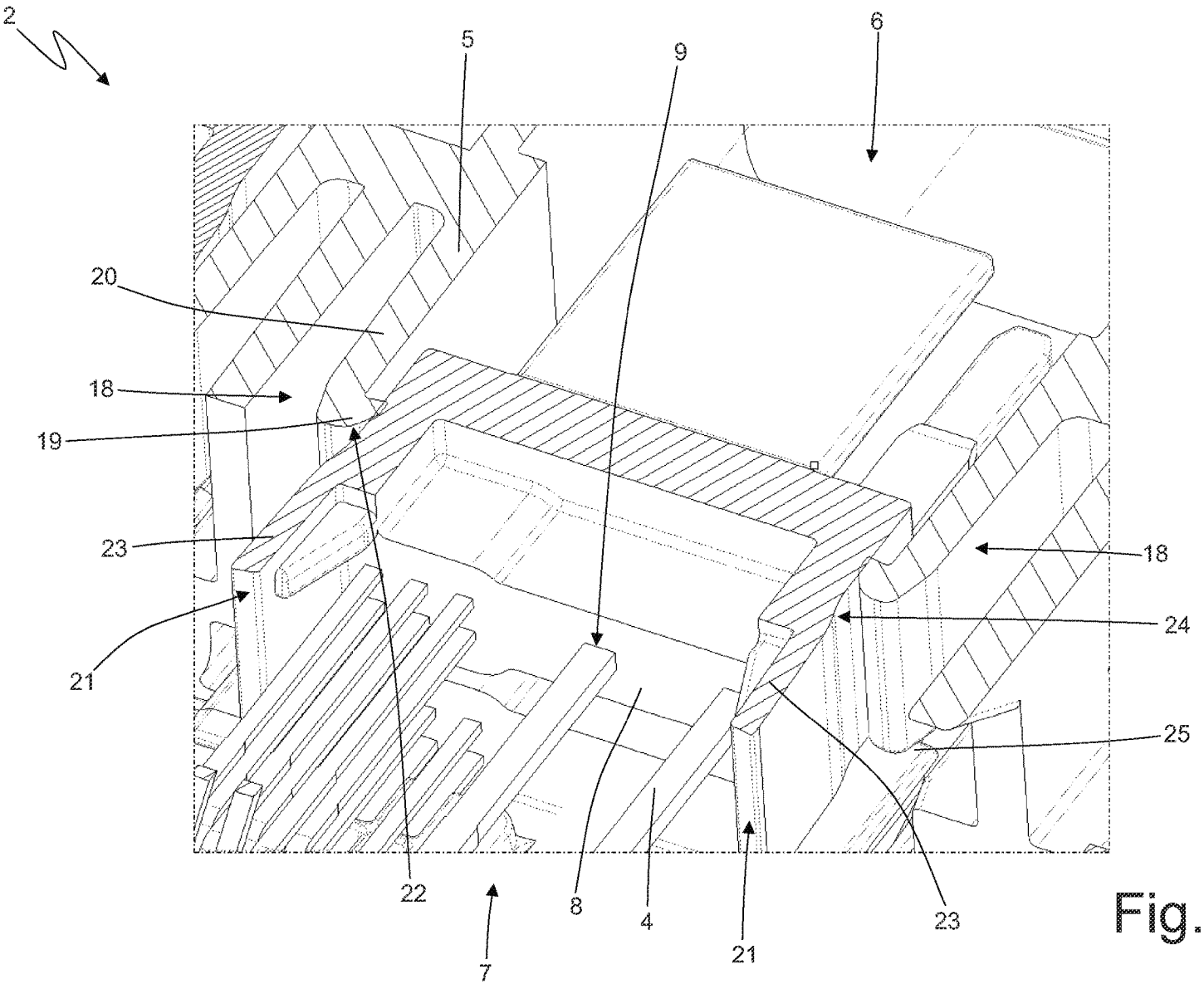
FIGS. 12 and 13 are cross-sectional perspective views of a part of the pin header connector of FIG. 8 during two different mounting steps.
Figure 13:
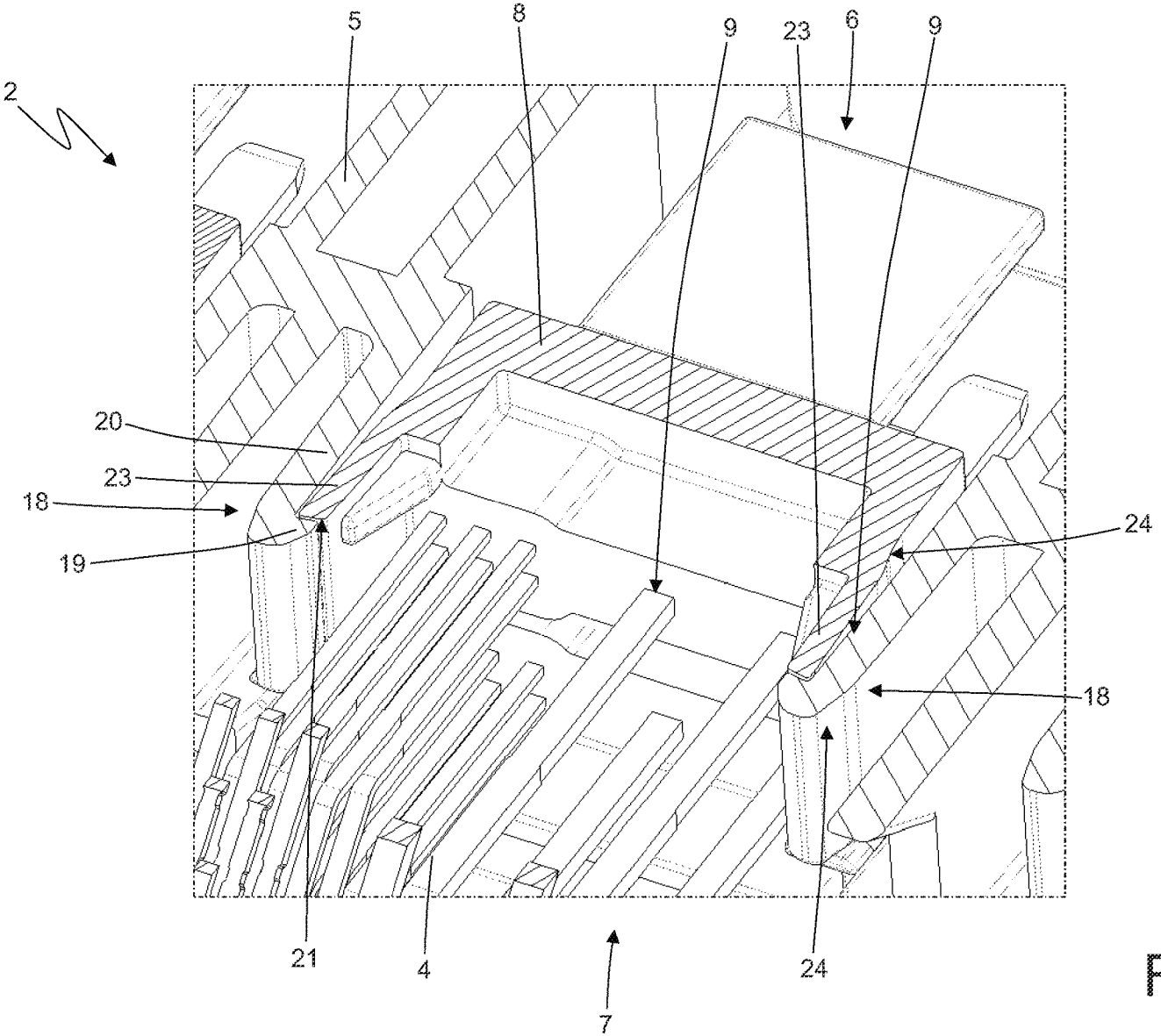

For each through opening 6, the interlocking connection system 18 comprises a series of teeth 19, which project towards the inside of each through opening 6 and are connected to the peripheral frame 5 by means of an elastically deformable arm 20. Furthermore, the interlocking connection system 18 comprises a series of abutments 21, which are obtained in the support plate 8 of each module 7 and are designed to receive the teeth 19. According to FIG. 4, for each through opening 6, four teeth 19 are provided, which are arranged around the linear sliding guide 14, and, therefore, for the support plate 8 of each module 7 there are provided four abutments 21; according to a different embodiment (shown, for example, in FIG. 10), for each through opening 6, two teeth 19 are provided, which are arranged in the area of opposite sides of the linear sliding guide 14 and, therefore, for the support plate 8 of each module 7 there are provided two abutments 21.

Namely, each through opening 6 has two or four teeth 19, which are arranged one or two on the right and one or two on the left of the through opening 6, and the support plate 8 of each module 7 has two or four abutments 21, which are arranged one or two on the right and one or two on the left of the support plate 8.

According to other embodiments which are not shown herein, the number, the shape and/or the arrangement of the teeth 19 (and, hence, of the abutments 20) are different.

According to a preferred embodiment shown in FIGS. 6 and 7, each tooth 19 has an inclined outer wall 22 and each abutment 21 is obtained in a body 23 that is an integral part of the support plate 8 and has an inclined outer wall (generally having an inclination that is similar to the inclined outer wall 22); during the sliding of a support plate 8 along the mounting direction D, each inclined outer wall 22 slides on the corresponding inclined outer wall 24 pushing its own tooth 19 outwards, thus allowing its tooth 19 to move past the corresponding body 23 in order to rest against the abutment 21 at the end of the mounting movement. According to FIG. 3, the support plate 8 of each module 7 comprises two pushing areas 25, which make up pushing zones on which a force can be applied, which is oriented along the mounting direction D, so as to couple the support plate 8 in a corresponding through opening 6 of the peripheral frame 5; in particular, the two pushing areas 25 are arranged at the two opposite ends of the support plate 8, namely one on the right side of the support plate 8 and the other on the left side of the support plate 8. In the embodiment shown in FIG. 3, the pushing areas 25 are defined at the top of respective columns that are oriented parallel to the mounting direction D and project from the support plate 8. In other words, during the assembly of the pin header connector 2, the support plate 8 of each module needs to be pushed, with a given force, into the corresponding through opening 6 and along the mounting direction D until striking of the limit stop 15 and until activation (following an elastic deformation of the arms 20) of the connection system 18; however, pushing the support plate 8 of each module 7 with a given force without touching in any way the electrical pin contacts 4 (which, for they are very thin, can easily be deformed) can be complicated. For this reason, the pushing areas 25 are provided, which provide pushing zones on which a force can be applied, which is oriented along the mounting direction D, in order to couple the support plate 8 in a corresponding through opening 6 of the peripheral frame 5.

FIGS. 8-15 show a variant of the pin header connector 2 shown in FIGS. 2-7.

The pin header connector 2 shown in FIGS. 8-15 is different from the pin header connector 2 shown in FIGS. 2-7 in that, in the pin header connector 2 shown in FIGS. 8-15, each through opening 6 only has two teeth 19 (instead of four) arranged one on the right and one on the left of the through opening 6 (as shown, for example, in FIGS. 10, 12 and 13) and, as a consequence, the support plate 8 of each module 7 only has two abutments 21 (instead of four) arranged one on the right and one on the left of the support plate 8. The presence of two sole teeth 19 (with a larger size) instead of four teeth 19 (with a smaller size) makes it easier and quicker for the modules 7 to be inserted into the corresponding through openings 8 of the peripheral frame 5, as the coupling of two teeth 19 (with a larger size) in the respective abutments 21 is easier to handle than the coupling of four teeth 19 (with a smaller size) in the respective abutments 21.

The pin header connector 2 shown in FIGS. 8-15 is different from the pin header connector 2 shown in FIGS. 2-7 in that, in the pin header connector 2 shown in FIGS. 2-7, each abutment 21 is recessed into the support plate 8 (as shown, for example, in FIG. 6) and, hence the corresponding body 23 remains within the dimensions of the remaining part of the support plate 8, whereas, in the pin header connector 2 shown in FIGS. 8-15, each abutment 21 is arranged at a given distance from the remaining part of the support plate 8 (as shown, for example, in FIG. 12) and, hence, the corresponding body 23 projects from the support plate 8.

The pin header connector 2 shown in FIGS. 8-15 is different from the pin header connector 2 shown in FIGS. 2-7 in that, in the pin header connector 2 shown in FIGS. 8-15, each guide wall 17 obtained in the support plate 8 is coupled, with a given interference (namely, with an interference other than zero), to the corresponding guide wall 16 obtained in a linear guide 14 of a through opening 6 of the peripheral frame 5; in other words, due to the interference coupling between each guide wall 17 obtained in the support plate 8 and the corresponding guide wall 16 obtained in a linear guide 14 of a through opening 6, in order to insert a support plate 8 into the corresponding through opening 6, a (small) deformation (which tends to be elastic) of the support plate 8 and of the peripheral frame 5 is needed. This deformation requires a greater force to insert support plate 8 into the corresponding through opening 6 and, hence, a greater force is also needed to remove the support plate 8 from the corresponding through opening 6, thus increasing the "resistance" (firmness) of the coupling between a support plate 8 and the peripheral frame 5.

Figure 14:
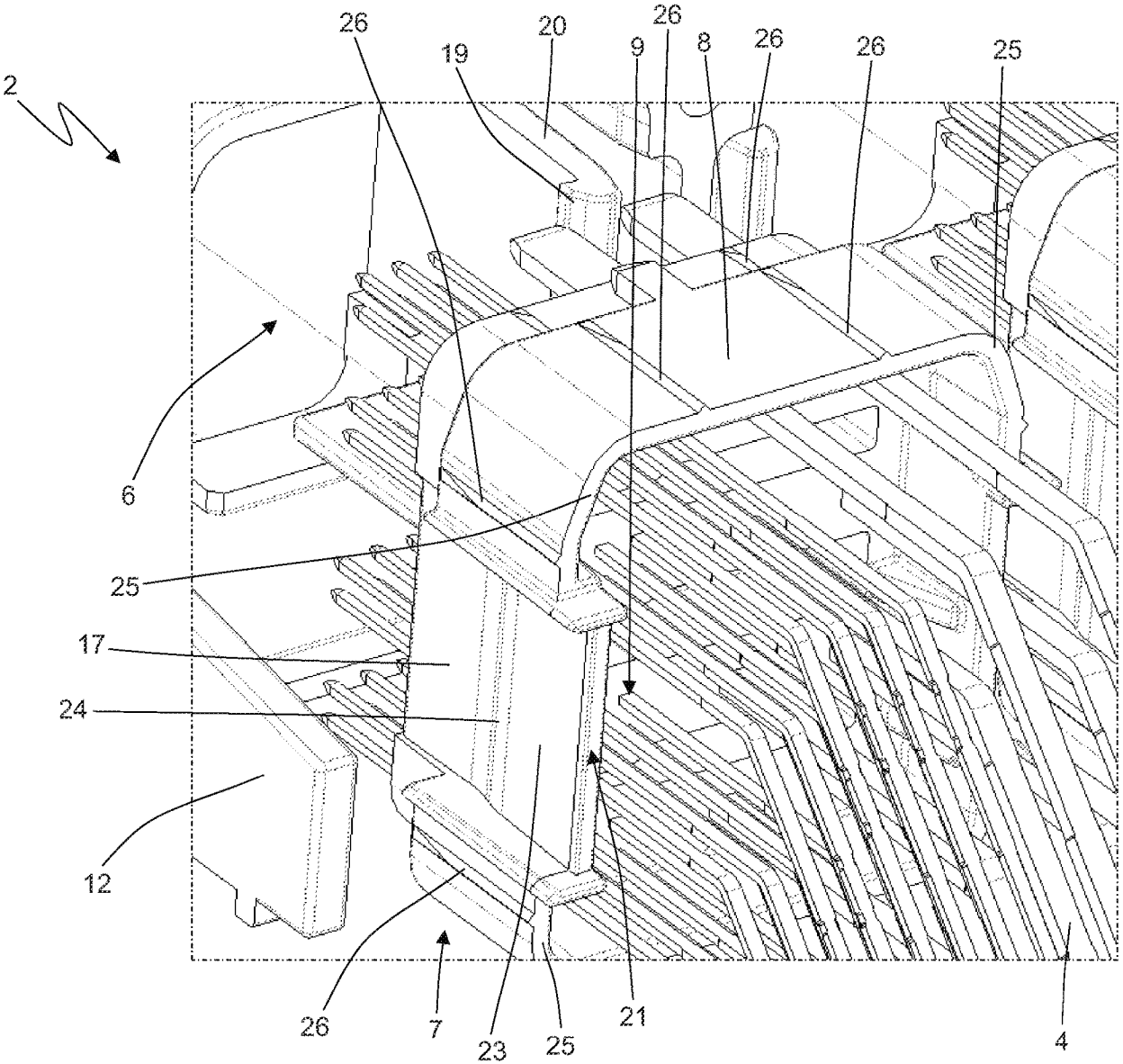
FIGS. 14 and 15 are two different perspective views of a part of the pin header connector of FIG. 8 during the assembly.
Figure 15:
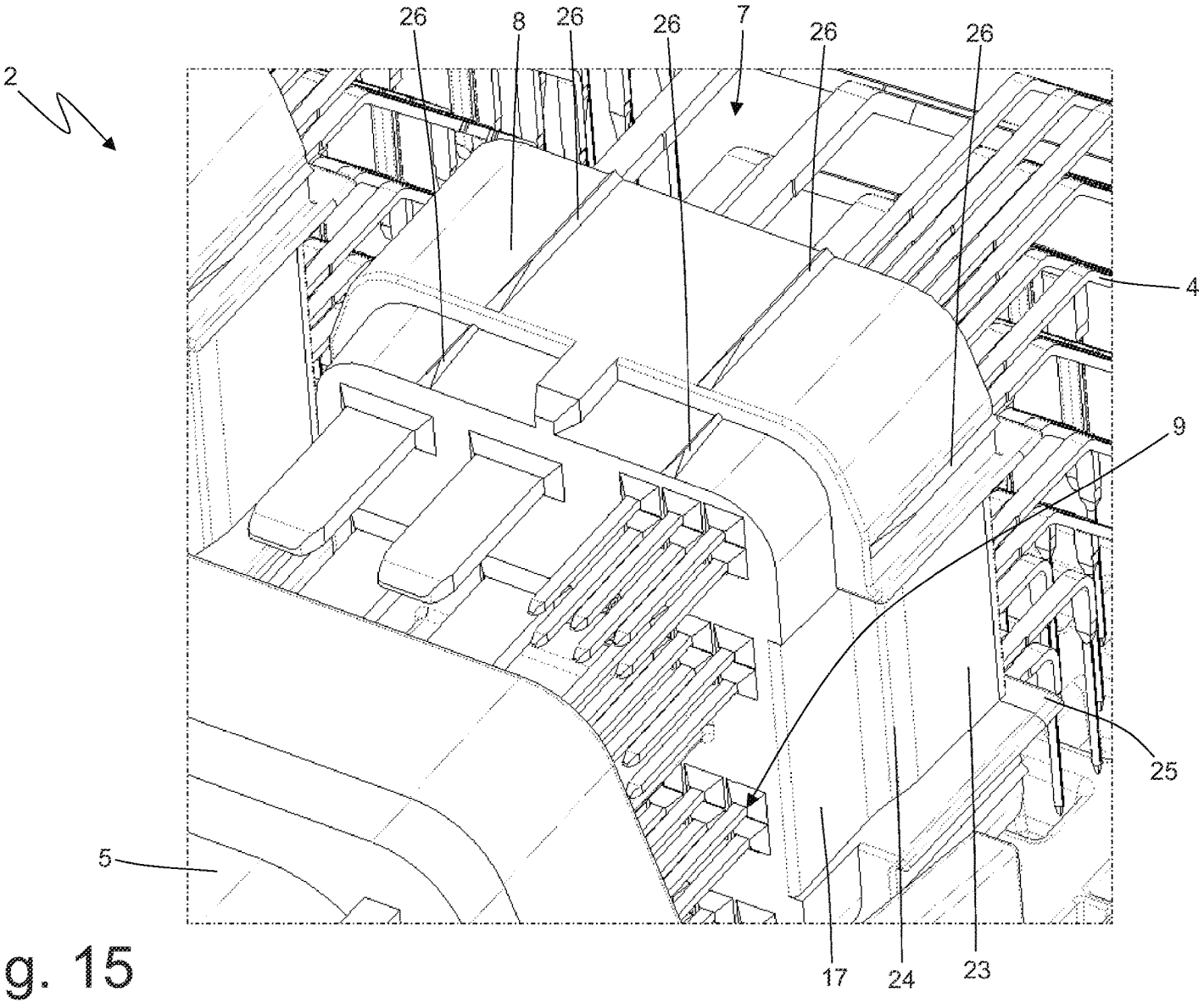

According to a preferred embodiment shown in FIGS. 14 and 15, each guide wall 17 has a plurality of projections (protuberances, ribs) 26, which project from the walls of the support plate 8 and determine an interference with the walls of the corresponding through opening 6 of the peripheral frame 5; namely, the interference coupling between each support plate 8 and the corresponding through opening 6 is only and exclusively determined by the presence of the projections 26, which project from the walls of the support plate 8. Preferably, the projections 26 are not present in the guide walls 17.

According to a preferred embodiment, each projection 26 is oriented parallel to the mounting direction D. According to a preferred embodiment shown in FIG. 16, each projection 26 generally has a maximum thickness H ranging from 0.1 to 0.3 mm and, in particular, has a maximum thickness of approximately 0.2 mm. According to a preferred embodiment shown in FIG. 16, each projection 26 has a front portion (namely, a portion that is the first to come into contact with the corresponding guide wall 16 obtained in a linear guide 14 relative to the mounting direction D) shaped like a wedge (namely, having an inclined plane that progressively increases the thickness moving forward in the mounting direction D) so as to determine a progressive deformation when the support plate 8 of a module 7 is inserted into the corresponding through opening 6 of the peripheral frame 5.

To sum up, the interference coupling between each support plate 8 and the corresponding through opening 6 requires a substantially elastic deformation of the support plate 8 and of the peripheral frame 5 and requires an at least partially plastic deformation of the projections 26 (which carry out an interference action).

Figure 16:
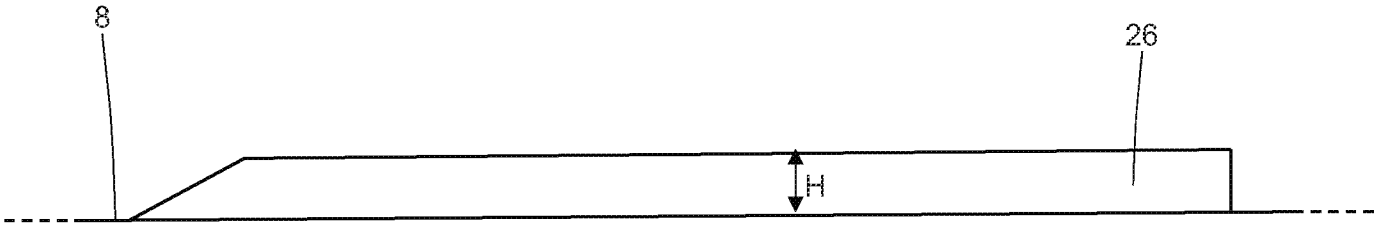
FIG. 16 is a schematic view of a projection of a guide wall of a support plate of the pin header connector of FIG. 8.

In the embodiment shown in FIGS. 14, 15 and 16, the projections 26 are only present on the walls of the support plates 8; according to other embodiments which are not shown herein, the projections 26 are also present on the walls of the through openings 6 or the projections 26 are only present on the walls of the through openings 6.

The pin header connector 2 shown in FIGS. 8-15 has four pushing areas 25, which are arranged at the two opposite ends of the support plate 8, namely two on the right side of the support plate 8 and the other two on the left side of the support plate 8; in particular, the four pushing areas 25 are arranged around the guide walls 17 in the area of the four vertexes of the support plate 8. In the embodiment shown in FIGS. 8-15, the pushing areas 25 are defined at the top of an annular edge, which surrounds each support plate 8, is oriented parallel to the mounting direction D and projects from the support plate 8.

The assembly of the pin header connector 2 entails inserting one single module 7 at a time into the through openings 6 of the peripheral frame 5 by pushing the module 7 along the mounting direction D with a given force (especially when there are the projections 26) and by applying the pushing force to the module 7 pressing on the corresponding pushing areas 25; namely, the assembly of the pin header connector 2 entails applying the thrust (along the mounting direction D) to the support plate 8 of a module 7 by only pressing the tops of the corresponding pushing areas 25 (arranged on the two opposite sides of the support plate 8). Each module 7 is pushed along the mounting direction D until the corresponding support plate 8 comes into contact with the corresponding limit stops and, hence, until the two (four) teeth 19 of the support plate 8 engage the corresponding abutments 21.

Each module 7 is secured to the peripheral frame 5 only by means of a mechanical coupling (namely, by means of a mechanical interlocking) without any type of gluing with adhesive and without any type of hot welding.

It should be pointed out that each module 7 is completely separate from and independent of the other modules 7, has no point of contact with the other modules 7 except for the contact through the peripheral frame 5 and can be inserted in the peripheral frame 5 alone and completely independently of the other modules 7; this feature leads to two positive effects: first of all, the same module 7 can easily be used to make up pin header connectors 2 with different dimensions (namely, it is sufficient to use a smaller or larger number of modules 7, which are all of the same type) and, furthermore, the fixing of the modules 7 in the peripheral frame 5 requires a smaller pushing force, as one single module 7 at a time can be locked in place (therefore, there is no risk of deforming or breaking the peripheral frame 5 due to excess mechanical stresses).

The embodiments described herein can be combined with one another, without for this reason going beyond the scope of protection of the invention.

The pin header connector 2 according to the invention has different advantages.

In particular, the pin header connector 2 described above is easy and economic to be manufactured, as it consists of a limited number of components, which can be manufactured, for example, through injection mounding (especially when the peripheral frame 5 is also made of a plastic material), and since it can easily be mounted in an automated manner.

The plastic moulding processes, the bending processes performed to bend the electrical pin contacts 4 and the assembling processes are carried out on the single modules 7 with a small size and a small number of ways (namely, of electrical pin contacts 4), hence these processes are relatively simple.

By keeping the design of the single module 7 unchanged and by changing the number of modules 7 and the design of the peripheral frame 5 it is possible to obtain new pin header connectors 4 investing in the sole part of the processes defining the manufacturing and the assembly of the peripheral frame 5; namely, the module-based concept allows for a reduction in the initial investment for new pin header connectors 2, exploiting the existing modules 7.

Hence, in order to obtain a new pin header connector 2, it is only necessary to invest in the plastic mould of the peripheral frame 5 and in the conversion of the mounting line, so as to accept the new peripheral frame 5, re-using what is already available for the manufacturing of the single modules 7.

LIST OF THE REFERENCE NUMBERS OF THE FIGURES

1 electronic control unit
2 pin header connector
3 container
4 electrical pin contacts
5 peripheral frame
6 through openings
7 modules
8 support plate
9 through holes
10 holding plate
11 through holes
12 mounting brackets
13 hooks
14 linear sliding guides
15 limit stop
16 guide walls
17 guide walls
18 connection system
19 teeth
20 arm
21 abutments
22 inclined outer wall
23 body
24 inclined outer wall
25 pushing areas
26 projections
D mounting direction
H height

The invention claimed is:

1. A pin header connector comprising:

a peripheral frame having, at the center, a series of through openings; and a plurality of modules, each of which engages a corresponding through opening and is provided with a series of electrical pin contacts and with a support plate, which is made of a plastic material and has a series of first through holes engaged by the corresponding electrical pin contacts;

wherein the peripheral frame has a plurality of linear sliding guides, each of which is arranged in the area of a through opening, is designed to guide an insertion of the support plate of a module into the through opening allowing the support plate to only make a translation in a mounting direction (D), and is provided with a limit stop ending the insertion;

wherein an interlocking connection system is provided, which is activated when the support plate of each module strikes against the limit stop and, once it is activated, prevents the support plate from moving away from the through opening, thus creating a firm connection between the support plate and the peripheral frame;

wherein each module is completely separate from and independent of the other modules, has no point of contact with the other modules except for the contact through the peripheral frame and can be inserted in the peripheral frame alone and completely independently of the other modules; and wherein, for each through opening, the interlocking connection system includes a series of first teeth, which project towards the inside of the through opening and are connected to the peripheral frame by an elastically deformable arm; and a series of abutments, which are obtained in the support plate of the corresponding module and are designed to receive the first teeth.

2. The pin header connector according to claim 1, wherein:

each first tooth has a first inclined outer wall;

each abutment is obtained in a body that is an integral part of the support plate and has a second inclined outer wall.

3. The pin header connector to claim 1, wherein each through opening has only two first teeth arranged one on the right and one on the left and the support plate of each module has only two abutments arranged one on right and one on the left.

4. The pin header connector according to claim 1, wherein each abutment is arranged at a given distance from the remaining part of the support plate and, hence, the corresponding body projects from the support plate.

5. The pin header connector according to claim 1, wherein each linear sliding guide has a flared shape that progressively reduces its size as the support plate of a corresponding module moves forward in its insertion.

6. The pin header connector according to claim 1, wherein each module engages a corresponding through opening with mechanical interference and, hence, only due to a deformation of the module and/or of the peripheral frame.

7. The pin header connector according to claim 6, wherein the walls of each support plate or of each through opening have a plurality of projections, which project from the walls and determine an interference between each support plate and the corresponding through opening.

8. The pin header connector according to claim 7, wherein each projection is oriented parallel to the mounting direction (D) and has a wedge-shaped front portion.

9. The pin header connector according to claim 1, wherein:

the support plate of each module comprises at least two pushing areas, which make up pushing zones on which a force can be applied, which is oriented along the mounting direction (D), so as to couple the support plate in a corresponding through opening of the peripheral frame; and the pushing areas are defined at the top of elements that are oriented parallel to the mounting direction (D) and project from the support plate.

10. The pin header connector according to claim 1, wherein:

each electrical pin contact has a straight front portion, which engages a first through hole of a corresponding support plate, a rear straight portion, which is perpendicular to the front portion and is configured to be coupled to a printed circuit board, and a joining portion, which connects the front portion to the rear portion; and at least one holding plate is provided, which is perpendicular to the support plates and has a series of second through holes, which are engaged by the rear portions of the corresponding electrical pin contacts.

11. The pin header connector according to claim 10, wherein the second through holes of a same holding plate are engaged by the rear portions of the electrical pin contacts of at least two modules beside one another.

12. A method for mounting a pin header connector according to claim 1 and comprising the steps of:

providing the peripheral frame;

providing a plurality of modules; and inserting one single module at a time into the through openings of the peripheral frame by pushing the module along the direction (D).

13. The mounting method according to claim 12, wherein:

the support plate of each module comprises at least two pushing areas, which are defined at the top of elements that are oriented parallel to the mounting direction (D) and project from the support plate; and each module is pushed along the mounting direction (D) and into a corresponding through opening of the peripheral frame by pressing the corresponding support plate only and exclusively on the pushing area.

14. The mounting method according to claim 12, wherein the modules are fixed to the peripheral frame only and exclusively by mechanical interlocking and, hence, without using gluing or welding.

15. A pin header connector comprising:

a peripheral frame having, at the center, a series of through openings; and a plurality of modules, each of which engages a corresponding through opening and is provided with a series of electrical pin contacts and with a support plate, which is made of a plastic material and has a series of first through holes engaged by the corresponding electrical pin contacts;

wherein the peripheral frame has a plurality of linear sliding guides, each of which is arranged in the area of a through opening, is designed to guide an insertion of the support plate of a module into the through opening allowing the support plate to only make a translation in a mounting direction (D), and is provided with a limit stop ending the insertion;

wherein an interlocking connection system is provided, which is activated when the support plate of each module strikes against the limit stop and, once it is activated, prevents the support plate from moving away from the through opening, thus creating a firm connection between the support plate and the peripheral frame;

wherein each module is completely separate from and independent of the other modules, has no point of contact with the other modules except for the contact through the peripheral frame and can be inserted in the peripheral frame alone and completely independently of the other modules;

wherein each electrical pin contact has a straight front portion, which engages a first through hole of a corresponding support plate, a rear straight portion, which is perpendicular to the front portion and is configured to be coupled to a printed circuit board, and a joining portion, which connects the front portion to the rear portion; and wherein at least one holding plate is provided, which is perpendicular to the support plates and has a series of second through holes, which are engaged by the rear portions of the corresponding electrical pin contacts.

16. The pin header connector according to claim 15, wherein the second through holes of a same holding plate are engaged by the rear portions of the electrical pin contacts of at least two modules beside one another.

17. A method for mounting a pin header connector according to claim 15 and comprising the steps of:

providing the peripheral frame;

providing a plurality of modules; and inserting one single module at a time into the through openings of the peripheral frame by pushing the module along the direction (D).

18. The mounting method according to claim 17, wherein:

the support plate of each module comprises at least two pushing areas, which are defined at the top of elements that are oriented parallel to the mounting direction (D) and project from the support plate; and each module is pushed along the mounting direction (D) and into a corresponding through opening of the peripheral frame by pressing the corresponding support plate only and exclusively on the pushing area.

* * * * *